US011525298B2

(12) United States Patent
Froude

(10) Patent No.: US 11,525,298 B2
(45) Date of Patent: Dec. 13, 2022

(54) FRAME CONSTRUCTION METHOD

(71) Applicant: Michael Froude, Edinburgh (GB)

(72) Inventor: Michael Froude, Edinburgh (GB)

( * ) Notice: Subject to any disclaimer, the term of this patent is extended or adjusted under 35 U.S.C. 154(b) by 70 days.

(21) Appl. No.: 16/950,256

(22) PCT Filed: May 17, 2019

(86) PCT No.: PCT/GB2019/051377
§ 371 (c)(1),
(2) Date: Nov. 17, 2020

(87) PCT Pub. No.: WO2019/220141
PCT Pub. Date: Nov. 21, 2019

(65) Prior Publication Data

US 2021/0238916 A1 Aug. 5, 2021

(30) Foreign Application Priority Data

May 18, 2018 (GB) ..... 1808161

(51) Int. Cl.
*E06B 3/964* (2006.01)
*E06B 1/52* (2006.01)
(Continued)

(52) U.S. Cl.
CPC ..... *E06B 3/9647* (2013.01); *E06B 1/52* (2013.01); *E06B 3/06* (2013.01); *E06B 3/9642* (2013.01); *E06B 3/9687* (2013.01); *E06B 3/984* (2013.01)

(58) Field of Classification Search
CPC . E06B 1/52; E06B 3/06; E06B 3/9642; E06B 3/9647; E06B 3/9687; E06B 3/987
(Continued)

(56) References Cited

U.S. PATENT DOCUMENTS 1,789,345 A * 1/1931 Swanson ..... E06B 3/984 52/656.2
6,393,779 B1 * 5/2002 Boldt ..... E06B 1/10 52/745.15
(Continued)

FOREIGN PATENT DOCUMENTS

AU 2009236042 A1 5/2011
CN 202467490 U 10/2012
(Continued)

OTHER PUBLICATIONS

Jan Hellberg, WIPO International Search Report, dated Sep. 13, 2019, EPO, Rijswijk, NL.
(Continued)

*Primary Examiner* — Brian E Glessner
*Assistant Examiner* — James J Buckle, Jr.
(74) *Attorney, Agent, or Firm* — Kearney, McWiliams & Davis; Erik J. Osterrieder

(57) ABSTRACT

The invention is a method, an apparatus and a kit of parts for assembling a universal frame with at least two jambs, a lintel and a sill. The resulting frame is suitable for any size of opening and any size of door, with the option to include single doors or double doors as well as side screens and/or side lights. The frame is typically assembled by cutting the jambs (and optionally the sill and/or lintel) to a selected size, attaching keys to each end of each jamb and inserting the keys into keying channels in the sill and lintel.

15 Claims, 12 Drawing Sheets

(51) Int. Cl.
*E06B 3/06* (2006.01)
*E06B 3/968* (2006.01)
*E06B 3/984* (2006.01)

(58) Field of Classification Search
USPC ..... 52/204.2
See application file for complete search history.

(56) References Cited

U.S. PATENT DOCUMENTS 6,637,158 B2 * 10/2003 Bennett ..... E06B 3/9632 49/504
6,763,639 B2 * 7/2004 Bennett ..... E06B 3/9632 49/504
6,789,359 B2 * 9/2004 Bauman ..... E06B 3/9632 49/471
9,845,633 B2 * 12/2017 Wang ..... E06B 3/223
10,941,606 B1 * 3/2021 Kendall ..... E06B 1/524
11,280,110 B1 * 3/2022 Moeller ..... E05B 15/0205
2004/0128925 A1 * 7/2004 Massey ..... E06B 1/70 52/204.1
2014/0102017 A1 * 4/2014 Booi ..... E06B 1/52 52/204.1
2017/0234060 A1 * 8/2017 Graetsch ..... E06B 7/14 49/471
2020/0157877 A1 * 5/2020 McKinnon ..... E06B 7/26
2020/0232268 A1 * 7/2020 Li ..... E06B 1/524

FOREIGN PATENT DOCUMENTS

EP 0087848 A1 9/1983
EP 0167270 A1 1/1986
FR 2450336 A1 9/1980
FR 2996610 A1 4/2014

OTHER PUBLICATIONS

Jan Hellberg, WIPO Written Opinion, dated Sep. 13, 2019, EPO, Rijswijk, NL.
Jacob Swatton, UKIPO Search Report under Section 17(5), dated Nov. 6, 2019, UKIPO, Newport, GB.

* cited by examiner

FRAME CONSTRUCTION METHOD

REFERENCE TO RELATED APPLICATIONS

This is a US non-provisional patent application, which enters the national stage under 35 U.S.C. § 371 from and claims priority to Patent Treaty Cooperation application number PCT/GB2019/051377 filed on May 17, 2019, which claims priority to GB provisional patent application serial number GB1808161.2 filed on May 18, 2019, each of which are hereby incorporated by this reference in their entireties.

FIELD

The field of the invention relates to joinery and more particularly to structural components for frames intended to accommodate doors or windows, and to methods for assembly of frames and buildings including frames.

BACKGROUND

At the present time, frames for doors have been available in standard sizes and considerable additional effort has been required where a non-standard size of frame is preferred. Frames are designed to only fit doors (and/or side lights and/or side screens) that have been manufactured by the same company. On occasions when either a door or a frame is unavailable from a chosen manufacturer this can lead to delays in building during the period that the items are unavailable, or additional work in order to customize a non-standard door or frame. Necessarily, both of these options are also associated with additional expense.

Typically, frames for doors (and windows) are constructed through the assembly of linear sections including two or more vertically positioned sections (typically known as legs, posts, or jambs), spatially separated to define the length of the frame and two or more horizontally positioned sections, one section arranged to define the upper limit of the frame (typically known as the head or lintel) and one section arranged to define the lower limit of the frame (typically known as the sill or cill). These linear sections are typically fixed in place such that the vertically positioned sections are substantially parallel to each other and substantially perpendicular to the horizontally positioned sections, thus defining a frame with a central space. Typically the frame and the central space are rectangular (typically oblong) and are configured such that a door may fit into the space.

Accordingly, the present invention seeks to remedy these issues with known frames by providing a method, apparatus, and kit of parts with which to build a frame suitable for retaining any size of door. The present invention allows such frames to be built quickly and without excessive waste. Due to the dimensional flexibility of the resulting frames these may also, in some circumstances, be less expensive than existing methods.

SUMMARY

According to a first aspect of the invention there is provided a method of assembling a frame (e.g., a doorframe or a window frame), the method comprising:

- forming a sill of a selected length (e.g., an overall opening length), the sill having at least one keying channel running along at least part of (or the whole of) a longitudinal surface of the sill;
- forming a lintel of a selected length (e.g., an overall opening length), the lintel having at least one keying channel running along at least part of (or the whole of) a longitudinal surface of the lintel;
- forming at least two jambs of a selected length, each jamb having longitudinally extending keys (e.g., dovetails) at either end, said keys shaped to cooperate with and be retained by said keying channels;
- inserting the keys at one end (e.g., the top end) of each jamb into the at least one keying channel of the lintel; and
- inserting the keys at the other end (e.g., the base) of each jamb into the at least one keying channel of the sill, to thereby form the frame.

In some embodiments, one or more of the jambs may be supplied with one key pre-formed (e.g., pre-attached) at one end, and the method may comprise cutting the jamb to a selected length and subsequently forming (e.g., attaching) a second key to the other end of the jamb. However, typically the method comprises forming (e.g., attaching) a key (e.g., a dovetail) to each end of each jamb. The method may method comprise cutting one or more jambs to a selected length and subsequently forming or attaching a key at least one end of the or each jamb.

In some embodiments, the at least one keying channel (e.g., a sliding dovetail channel) of the sill tapers towards the surface of the sill, i.e., the at least one keying channel is narrowest at the surface of the sill. In some embodiments, the at least one keying channel of the lintel tapers towards the surface of the lintel. i.e., it is narrowest at the surface of the lintel, for example it may be a sliding dovetail channel with a trapezoidal cross-section (e.g., one skilled in the art will appreciate that three sides of the trapezoid (typically the long base and the trapezoid legs) may be defined by the channel in the longitudinal surface of the sill or lintel while the fourth side of the trapezoid is defined by an open surface).

Typically, the forming of at least two jambs of a selected length, each jamb having longitudinally extending keys (e.g., dovetails) at either end comprises the step of attaching a key to each end of each jamb, optionally (e.g., preferably) through the use of a key jig. By a key jig we refer to a jig for locating a key at a defined location at the end of a jamb. Optionally, the forming of at least two jambs of a selected length comprises cutting (e.g., sawing) one or more (e.g., prefabricated) jambs to the selected length and the method further comprises attaching a key to each end of each jamb, optionally using a key jig to align the key. Typically, the method comprises the step of attaching a key to each end of each jamb, the step of attaching of a key to a jamb comprising the steps of:

- placing at least one key jig against and aligning the at least one key jig with an end (e.g., an upper end or a lower end) of the jamb;
- aligning a key with the or each key jig;
- attaching the or each key to the end of the jamb; and
- removing the or each key jig from the end of the jamb.

Typically, the step of attaching a key is repeated as often as needed to attach a key to each end of each jamb.

Typically, the aligning the at least one key jig with an end of a jamb comprises aligning the key jig in at least two dimensions (e.g., two dimensions perpendicular to the longitudinal dimension of the jamb) and restricting at least one rotational degree of freedom of the key jig to thereby correspondingly define the position of a key attached to the end of a jamb. Typically, the forming of the sill of a selected length and/or the lintel of a selected length and/or the at least two jambs of a selected length may comprise cutting (e.g., sawing) one or more lengths of material to a selected length.

Optionally, the forming of the sill of a predetermined length and/or the lintel of a selected length and/or the at least two jambs of a selected length may comprise joining together (e.g., through the use of adhesives) of two or more sections of material and/or 3D printing a section of material. In embodiments where the forming comprises cutting the cutting typically comprises cutting (e.g., sawing) completely through an (e.g., elongate) section of material in an orthogonal direction to the longest dimension of the section of material (and thereby producing two sections of material).

Typically, the forming (e.g., cutting) of a sill of a selected length and/or the lintel of a selected length and/or the at least two jambs of a selected length comprises forming the jambs and/or lintels and/or sills to a selected length by cutting (e.g., sawing) through a longer piece of material at the site of use (e.g., on a building site where a building is being constructed, in a building where a frame (e.g., a doorframe, optionally a window frame) is to be assembled or replaced, etc.) as opposed to being formed remotely (e.g., in a remote factory). However, jambs and/or lintels and/or sills may be formed (e.g., cut) to a selected length off-site and supplied as needed, for example for use in a building project for which multiple frames of the same size are required. In some embodiments the lintel and/or the sill may be pre-machined.

Typically, the or each key jig is configured to cooperate with the or each key and the or each jamb and to define the position and/or alignment of the or each key in relation a jamb when it is attached to the jamb. In some embodiments, aligning a key with the or each key jig comprises (e.g., slidably) inserting the key into a key space of the or each key jig.

Typically, the method comprises the step of separating the at least two jambs by a selected distance to thereby define the width of the frame (e.g., the internal surface of a first jamb will define the leftmost inner limit of the frame and the internal surface of a second jamb will define the rightmost inner limit of the frame). Optionally, the step of separating the at least two jambs comprises the steps of:

- inserting a first locator (e.g., a spacer, typically a strut, optionally an elongate strut) into at least one keying channel of the lintel;
- inserting a second locator (e.g., a spacer, typically a strut, optionally an elongate strut) into at least one keying channel of the sill; inserting the keys attached to the top of each jamb into the or each keying channel of the lintel; and
- inserting the keys attached to the base of each jamb into the or each keying channel of the sill.

The or each keying channel of the sill is in the aperture-facing surface of the sill (i.e., the or each keying channel is in a surface that is upwards-facing in use). The or each keying channel of the lintel is in the aperture-facing surface of the lintel (i.e., the or each keying channel is in a surface that is downwards-facing in use).

Typically, the or each spacer is formed (e.g., cut) to a selected size, such that the spacer will be of an appropriate length to define a separation distance of the first and second jambs, the separation distance defining the width of the frame.

The method is universal in that it is compatible with a wide range of frame dimensions. Because the method comprises the step of forming (e.g., cutting, for example) the lintel, the sill and the or each jamb to a selected size (i.e., corresponding to a desired frame size) the method is suitable for the production of any size of frame. Because the method comprises the step of attaching at least one key to each jamb, as opposed to (for example) cutting the shape of a key out of the or each jamb, the method minimizes waste. Because the method comprises the use of a key jig the method is simple, precise, and reliable and minimizes construction errors. Further, the method can be carried out quickly and without the need for specialized tools or equipment, and is thus, inexpensive.

Optionally, the method may further comprise:

- forming one or more additional jambs and/or one or more mullions each of a selected length, the or each additional jamb and/or the or each mullion having longitudinally extending keys at either end;
- inserting the keys attached to one end (e.g., the top) of the or each additional jamb and/or the or each mullion into the at least one keying channel of the lintel; and
- inserting the keys attached to the other end (e.g., the base) of the or each additional jamb and/or the or each mullion into the at least one keying channel of the sill. Typically, the forming of one or more additional jambs and/or one or more mullions each of a selected length. (the or each additional jamb and/or the or each mullion having longitudinally extending keys at either end) comprises attaching a key to each end of the or each additional jamb and/or the or each mullion, optionally (e.g., preferably) using a key jig to align the key. Typically, the step of attaching of a key comprises the steps of:
- placing at least one key jig against and aligning the at least one key jig with an end (e.g., an upper end or a lower end) of one or more additional jambs and/or one or more mullions;
- aligning a key with the or each key jig;
- attaching the or each key to the end of the or each additional jamb and/or the or each mullion (e.g., using fastening means such as screws, bolts, nails and/or adhesives); and
- removing the or each key jig from the end of each additional jamb and/or the or each mullion;

Typically, the step of attaching a key is repeated as often as needed to attach a key to each end of the or each additional jamb and/or the or each mullion.

Typically, the method comprises separating the or each additional jamb from the first and second jambs by a selected distance. Optionally, the method comprises separating the or each mullion (where present) from the first and second jambs. Typically, the separating the additional jamb (and/or mullion) comprises the steps of:

- inserting an additional locator (e.g., a spacer typically a strut, optionally an elongate strut) into at least one keying channel of the lintel;
- inserting an additional locator (e.g., a spacer typically a strut, optionally an elongate strut) into at least one keying channel of the sill;
- inserting the keys attached to the top of each jamb (and/or mullion) into the keying channel of the lintel; and
- inserting the keys attached to the base of each jamb (and/or mullion) into the keying channel of the sill.

As such, the method is suitable for the construction of a frame such as a doorframe that (e.g., typically) retains a door and/or or a frame for double doors (e.g., a double doorframe) that retains two doors and/or or a doorframe comprising one or more side screens and/or sidelights. The method may also be used in the construction of a frame for retaining a window (e.g., a glass window). Optionally, the forming of at least two jambs (and/or the or each additional jamb and/or the or each mullion) of a selected length may comprise a calculation of a required length. Optionally, the forming of at least two jambs (and/or the or each additional jamb and/or the or each mullion) of a selected length may comprise a measurement of an opening space into which a frame will be received. Optionally, the forming of at least two jambs (and/or the or each additional jamb and/or the or each mullion) of a selected length may comprise a subtraction, for example of the length of one or more keys from the total selected length of a frame. It may be that the forming of at least two jambs (and/or the or each additional jamb and/or the or each mullion) of a selected length is carried out at the point of assembly of the frame, for example at a construction site, however this is not essential and it may be that the forming of at least two jambs (and/or the or each additional jamb and/or the or each mullion) of a selected length is carried out elsewhere.

The method may comprise carrying out some or all of the above-mentioned steps substantially in the order presented. Alternatively, the method may comprise carrying out the above-mentioned steps in a different order and/or carrying out (e.g., at least) some of the steps simultaneously.

According to a second aspect of the invention there is provided a frame construction apparatus (as a kit of parts), the apparatus comprising a plurality of keys and a key jig, the key jig comprising a locating formation (e.g., a side plate and/or a backing section) and a key retaining formation defining a key space, the key space configured to cooperate with (e.g., slidably receive) a key in use wherein the key jig and key space are configured to define the location of the end of a jamb where the key is to be attached. In some embodiments the key jig further comprises an access hole through which a key in the key space may be accessed in use, for example to allow screws, nails or bolts to be inserted into a key (optionally via through-bores in the key) and through the key into an end of a jamb to thereby attach the key to the end of the jamb. Where provided, the access hole is typically formed in a surface of the key jig that is parallel to an end surface of a jamb and/or mullion when the key jig is in use. Typically the locating formation comprises one or more walls (e.g., side plates and/or backing sections) which may be fitted level with one or more longitudinal surfaces of a jamb and/or a mullion in use.

In some embodiments, the key retaining formation defining a key space may be shaped such that a key can be slidably inserted into the key space but cannot be pulled vertically (i.e., in an orthogonal direction to the direction in which it is slidably inserted) out of the key space. Typically, the keying channel of the lintel is shaped to cooperate with a key, for example it may be shaped such that a key can be slidably inserted into the keying channel but cannot be pulled vertically (i.e., in an orthogonal direction to the direction in which it is slidably inserted) out of the keying channel. Typically, the keying channel of the sill is shaped to cooperate with a key, for example it may be shaped such that a key can be slidably inserted into the keying channel but cannot be pulled vertically (i.e., in an orthogonal direction to the direction in which it is slidably inserted) out of the keying channel. Optionally, the keying channel of the lintel is shaped to cooperate with a locator (e.g., a spacer), for example it may be shaped such that a locator can be slidably inserted into the keying channel but cannot be pulled vertically (i.e., in an orthogonal direction to the direction in which it is slidably inserted) out of the keying channel. Optionally, the keying channel of the sill is shaped to cooperate with a locator (e.g., a spacer), for example it may be shaped such that a locator can be slidably inserted into the keying channel but cannot be pulled vertically (i.e., in an orthogonal direction to the direction in which it is slidably inserted) out of the keying channel. Typically, the key space of the key jig and the or each keying channel comprise substantially geometrically similar cross-sections.

Optionally, the plurality of keys each comprises adhesive channels in one or more longitudinal surfaces of each key. Where each key has a trapezoidal (e.g., dovetail) cross-section, the adhesive channels are typically in one or more of the sloping surfaces of the key (i.e., surfaces which are not parallel to any of the other surfaces of the key). The adhesive channels reduce the frictional forces when a key is inserted into the key space of a key jig, or into the keying channel of a sill or the keying channel of a lintel. The adhesive channels can be filled with adhesive during construction of a (e.g., door) frame, to thereby increase the strength of any joint formed. Typically, the plurality of keys each comprise one or more (typically at least two) holes through which fastening means (e.g., screws, nails, bolts) can be inserted in use to thereby attach the key to a jamb or mullion.

In some embodiments (for example, where thicker frames are desired), the method may comprise attaching one or more further keys to the top of each jamb and/or to the base of each jamb and optionally inserting each key attached to the top of each jamb into at least one keying channel of the lintel and inserting each key attached to the base of each jamb into at least one keying channel of the sill. In a third aspect, the invention extends to a frame construction kit (a kit of parts) comprising a sill, the sill having at least one keying channel running along at least part of (or the whole length of) a longitudinal surface of the sill, a lintel, the lintel having at least one keying channel running along at least part of (or the whole length of) a longitudinal surface of the lintel, a first jamb and a second jamb, at least one key jig and a plurality of keys (e.g., dovetails), said keys shaped to cooperate with said keying channels and the at least one key jig. Optionally, the kit of parts may further comprise one or more mullions. The kit of parts is suitable for constructing a frame according to the method.

One advantage of the kit of parts according to the invention is that all necessary materials are provided, thus preventing the need to source additional components (which would increase the cost of a frame as well as the total time needed to assemble it).

Typically, the lintel comprises at least one keying channel configured to cooperate with a key in use, for example the keying channel may have the same cross-section as that of the plurality of keys such that one or more key may be slidably inserted into the channel. Typically, the sill comprises at least one keying channel configured to cooperate with a key in use, for example, the keying channel may have the same cross-section as that of the plurality of keys such that one or more key may be slidably inserted into the channel. Typically, the kit of parts further comprises one or more locator (e.g., one or more spacers, possibly in the form of elongate struts), each locator configured to cooperate with (e.g., slidably fit within) the at least one keying channel of the lintel and/or within the at least one keying channel of the sill.

Although typically the keying channel of the lintel and/or the keying channel of the sill will extend across the entire length of the lintel and/or the entire length of the sill, in some embodiments, the keying channel of the lintel and/or the keying channel of the sill may extend only a portion of the length of the lintel and/or sill (i.e., the channel may not extend the complete length of the lintel and/or of the sill), such that it would not be possible to insert a key beyond a predetermined distance into such a keying channel. In some embodiments a locator may comprise a spacer, for example an (e.g., elongate) strut. Alternatively or additionally, a locator may comprise stops or blocks. Typically, the spacer is of sufficient length that it separates the first and second keys such that the inner edges of the first and second jambs define the leftmost and rightmost inner edges of the (e.g., door) frame when the jambs are vertically positioned. Optionally, where more than one spacer is used, the combined total length of the spacers is such that it separates the first and second keys such that the inner edges of the first and second jambs define the leftmost and rightmost inner edges of the (e.g., door) frame when the jambs are vertically positioned.

The method may comprise configuring the kit of parts such that the lintel is arranged to be perpendicular to the first and second jambs and parallel to the sill, (i.e., the sill then also being perpendicular to the at least first and second jambs and parallel to the lintel and the first jamb being substantially parallel to the second jamb). As such, the assembly of the frame results in the first and second jambs being spatially separated to define the width of a frame, the lintel defines the upper limit of the frame and the sill defines the lower limit of the frame.

Typically, the frame (e.g., the sill, the lintel and/or the first and second jambs) comprises (e.g., linear sections of) timber. Optionally, the lintel may be longer than the sill, for example a lintel may have "horns". Typically, each jamb comprises an interior surface and an exterior surface.

The method typically comprises positioning the key jig at the top and/or at the base of the or each jamb (optionally the or each mullion) such that the locating formation (e.g., a side plate and/or a backing section) of the key jig is flush against the interior surface of the or each jamb (optionally the or each mullion). Typically, the key jig is configured such that, when the locating formation (e.g., a side plate and/or a backing section) of the key jig is positioned flush against the interior surface of the or each jamb (optionally the or each mullion) and a key is inserted, the key will be closer to the interior surface than it is to the exterior surface (e.g., the key may be 5 mm closer to the interior surface than to the exterior surface, or more typically 3 mm closer to the interior surface than to the exterior surface).

Optionally, the method may comprise attaching one or more beading pieces to the frame and thereby concealing joints.

Optionally, the kit of parts further comprises a door, the door configured to fit and typically to be retained by the frame when the frame has been assembled. Optionally, the kit of parts may further comprise one or more side screens, the or each side screen configured to fit and typically be retained by the frame when the frame has been assembled. Optionally, the kit of parts may further comprise one or more windows and/or one or more sidelights (e.g., one or more windows, optionally comprising glass) the or each window and/or the or each sidelight configured to fit and typically be retained by the frame when the frame has been assembled. Optionally, the kit of parts may further comprise one or more mullions suitable for separating the one or more side screens and/or one side lights from the or each other side screen and/or the or each other sidelight and/or the or each door. Optionally, the kit of parts may further comprise beading sections. Optionally, the kit of parts may further comprise fastening means (e.g., one or more screws, nails, bolts, and/or adhesives).

Typically, the or each key comprises a dovetail and the key space of the or each key jig and the keying channel of the lintel and the keying channel of sill will be configured to cooperate with (e.g., slidably receive) the dovetail. By dovetail we mean a prism having a trapezoidal cross-section. Typically, the cross-section of the or each key and/or the or each key space and/or the or each keying channel comprises tapering edges and optionally may have sections cut out of any of its surfaces. However one skilled in the art will appreciate that a range of shapes (e.g., shapes other than dovetails) would be suitable.

In some embodiments the method may be carried out on a factory line, for example with the use of one or more machines or robots. However, the method is more typically carried out by hand.

A fourth aspect of the invention provides a key jig, the key jig having a body comprising a locating formation and a key retaining formation defining a key space, the key space being configured to cooperate with a key in use and the key jig and key space configured to define the location of the end of a jamb where a key is to be attached. The locating formation is configured to locate the key jig relative to the end of a jamb during use. The locating formation may comprise a protrusion, e.g., a side portion, such as a plate, extending longitudinally from the edge of the body to locate the jig relative to an adjacent jamb in use.

In some embodiments, the key jig may further comprise an access hole through which a key located (e.g., demountably, typically slideably retained) in the key space may be accessed in use. For example, the access hole may be used to allow fastening means (e.g., screws, bolts, nails, etc.) to be passed therethrough and inserted through a key and into a jamb to thereby attach the key to the jamb. In some embodiments the key retaining formation of the key jig may have a trapezoidal (e.g., dovetail) cross-section (e.g., with the broader end located away from the jamb end in use).

A fifth aspect of the invention provides a key, the key being suitable for attachment to the end of a jamb and/or a mullion and for being retained by a keying channel (e.g., a keying 5 channel of a lintel and/or a keying channel of a sill) to thereby form a frame. Optionally, the key may be suitable for being retained by a key space of a key jig. In some embodiments, the key may comprise a dovetail (e.g., it may have a trapezoidal cross-section or have a dovetail cross-section). Typically, the cross-section of the key comprises tapering edges and optionally may have sections cut out of any of its surfaces. In some embodiments the key may comprise through-bores, for example holes through which fastening means (e.g., screws, bolts, nails, etc.) can be inserted in use to thereby fix the key to an end of a jamb and/or to an end of a mullion.

A sixth aspect of the invention provides a frame (e.g., a doorframe or a window frame) comprising a lintel, the lintel comprising at least one keying channel running along at least part of a longitudinal surface of the lintel, a sill, the sill comprising at least one keying channel running along at least part of a longitudinal surface of the sill, a first jamb having longitudinally extending keys at either end and a second jamb having longitudinally extending keys at either end the keys shaped to cooperate with said keying channels, wherein each key extending from the upper end of each jamb is retained in the keying channel of the lintel and each key extending from the lower end of each jamb is retained in the keying channel of the sill. Optionally, the frame may further comprise one or more additional jambs, wherein each additional jamb has longitudinally extending keys at either end and/or one or more mullions, wherein the or each mullion has longitudinally extending keys at either end, each key shaped to cooperate with said keying channels and wherein each key extending from the upper end of the or each additional jamb and/or the or each mullion is retained in the keying channel of the lintel and each key extending from the lower end of the or each additional jamb and/or the or each mullion is retained in the keying channel of the sill. Typically, in embodiments comprising one or more mullions, the frame further comprises at least one sidelight and/or at least one side screen. A seventh aspect of the invention provides a building, the building comprising one or more frames (e.g., one or more doorframes and/or one or more window frames) according to the sixth aspect of the invention. Optionally, the building may comprise one or more frames wherein the or each frame further comprises one or more additional jambs, wherein the or each additional jamb has longitudinally extending keys at either end and/or one or more mullions, wherein the or each mullion has longitudinally extending keys at either end, each key shaped to cooperate with said keying channels and wherein each key extending from the upper end of the or each additional jamb and/or the or each mullion is retained in the keying channel of the lintel and each key extending from the lower end of the or each additional jamb and/or the or each mullion is retained in the keying channel of the sill. Typically, in embodiments comprising one or more mullions, the frame further comprises at least one sidelight and/or at least one side screen.

DESCRIPTION OF THE DRAWINGS

Features described above in respect of any aspect of the invention are optional features of any other aspect of the invention.

An example embodiment of the present invention will now be illustrated with reference to the following Figures in which.

DETAILED DESCRIPTION OF AN EXAMPLE EMBODIMENT

Figure 1:
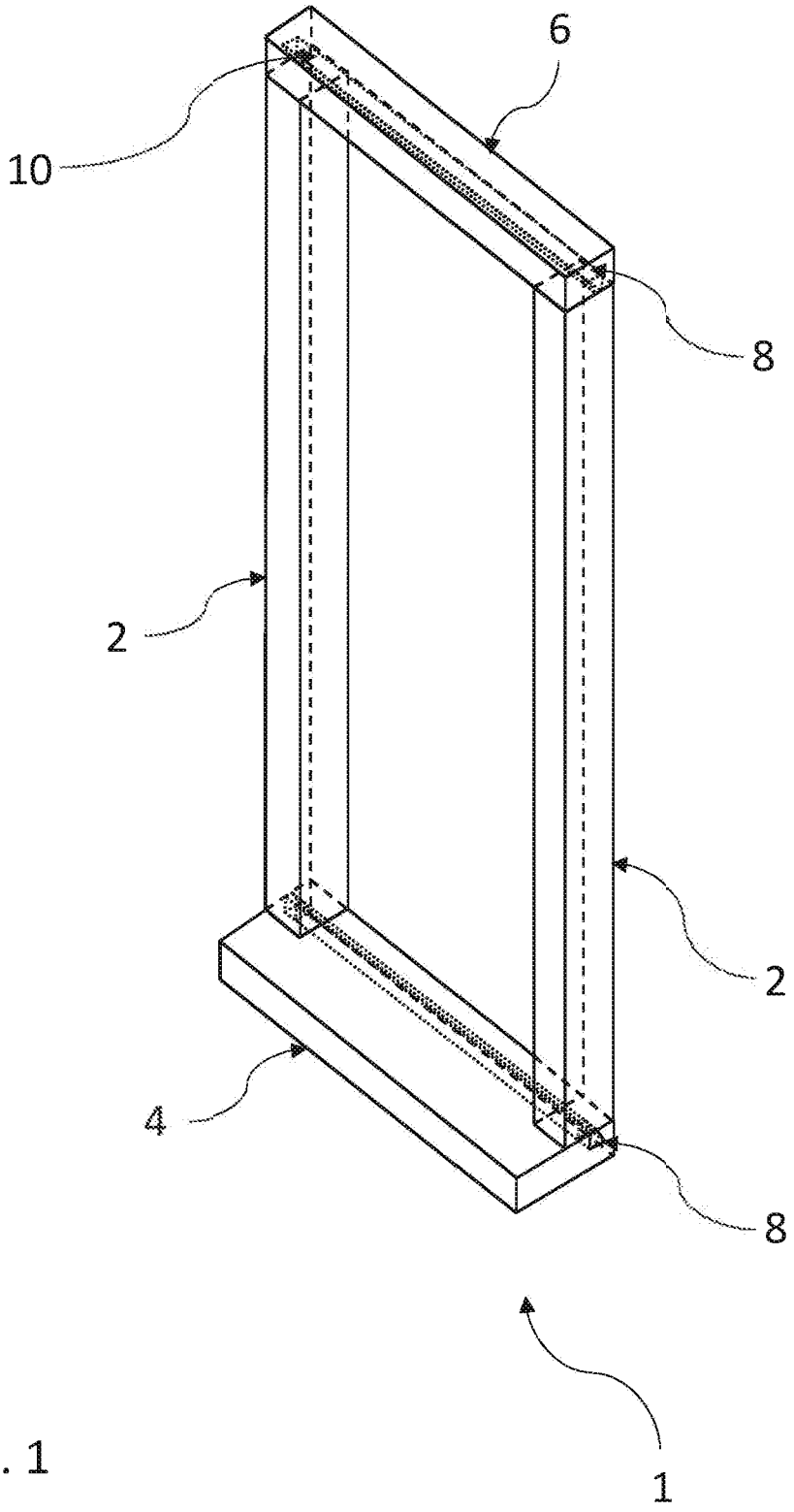
FIG. 1 is a perspective view of an example of a frame as constructed.

With reference to FIG. 1, in one example embodiment of the invention a frame (1) is formed with two jambs (2), a sill (4) and a lintel (6). Each jamb has a key (14) in the form of a dovetail attached to each end. The sill (4) has a dovetail slot (8) (functioning as a keying channel) running along the full length of the aperture-facing surface of the sill (4) and the lintel (6) has a dovetail slot (8) (functioning as a keying channel) running along the full length of the aperture-facing surface of the lintel (6).

Figure 2:
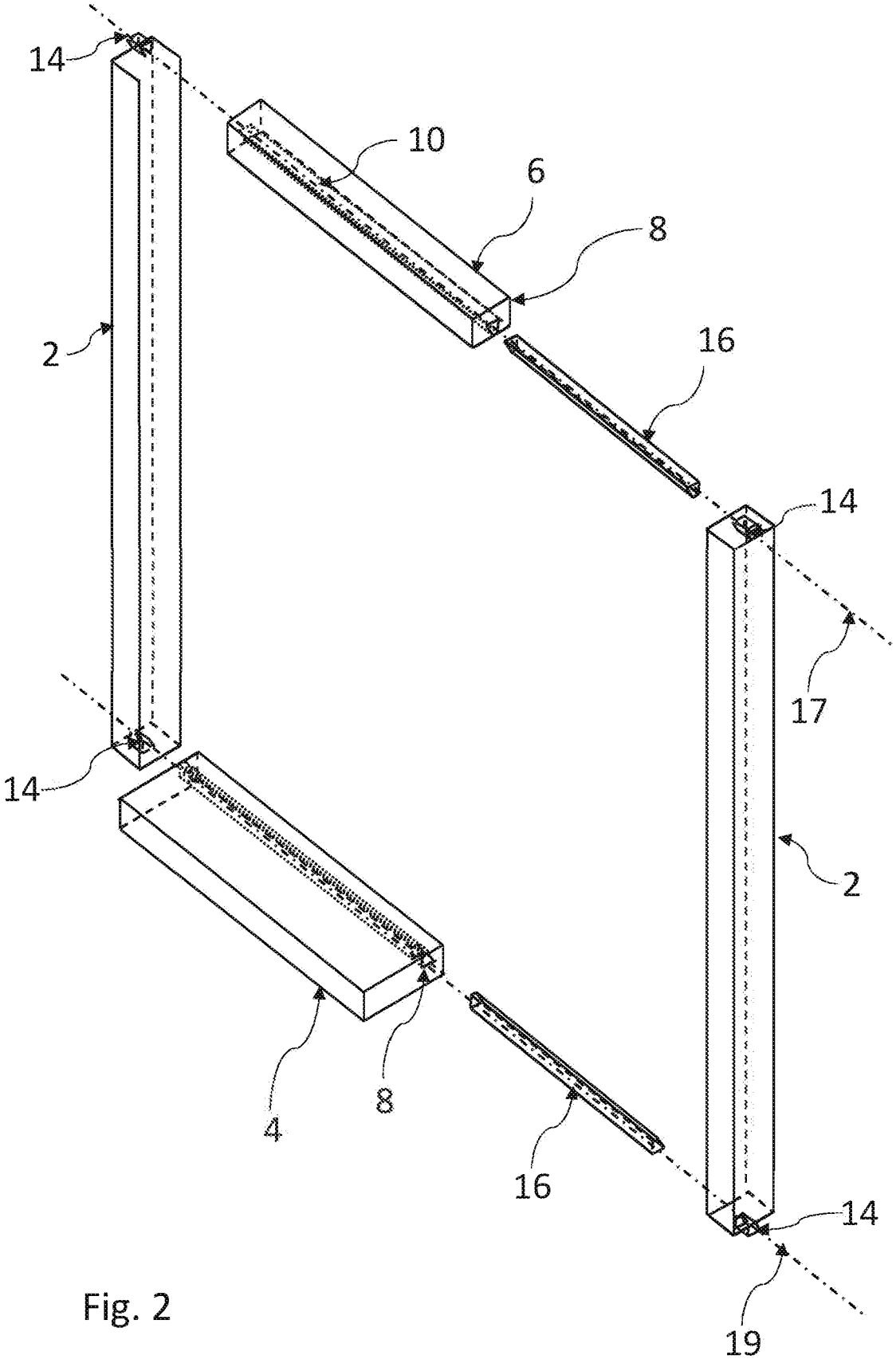
FIG. 2 is an exploded perspective view of the components of an example of a frame.

FIG. 2 is an exploded diagram of the same frame (1) as that of the diagram of FIG. 1, indicating the individual components of the frame. Here it can be seen that the keys (14) attached to the upper end of each jamb (2) can be slidably inserted (along an upper axis (17), shown for clarity) into the dovetail slots (8) of the lintel (6). Likewise, the keys (14) attached to the lower end of each jamb (2) can be slidably inserted (along a lower axis (19), shown for clarity) into the dovetail slots (8) of the sill (4). Additionally, spacers (16) can be slidably inserted into the dovetail slots (8) of the sill (4) and the lintel (6). The spacers (16) are used to control the separation distance of the two jambs (2) to thereby define the width of the frame (1).

Jambs (2), sills (4) and/or lintels (6) can be formed by cutting each to a desired length corresponding to the desired size of frame (1). Keys (14) configured to cooperate with the dovetail slots (8) of the sill (4) and the lintel (6) can then be attached to each end of each jamb (2). The positioning of the keys (14) is guided by a key jig (90) (see FIG. 8) configured to cooperate with the key (14) and to precisely align the key (e.g. in three linear dimensions as well as in at least one rotational degree of freedom) at the end of the jamb (2) such that it can be slidably received by a dovetail slot (8). In this way accurate positioning of each key (14) is ensured and thus the ease of assembly of a frame (1) is enhanced.

Figure 3A:
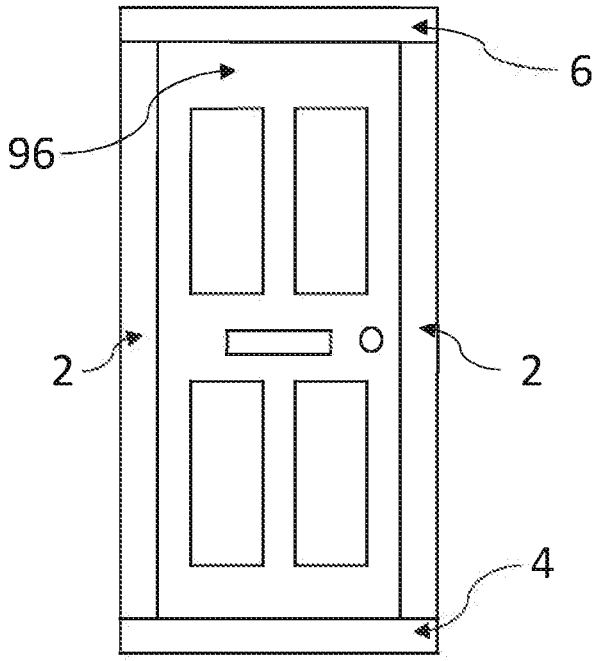
FIG. 3A is a plan view of a first example of a (door) frame as constructed, including a door.
Figure 3B:
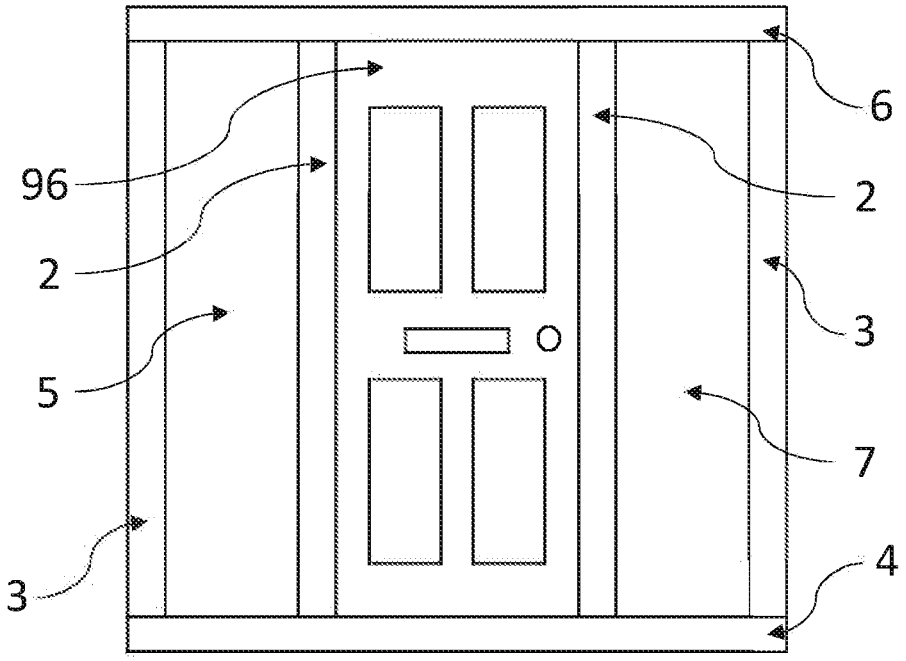
FIG. 3B is a plan view of a second example of a (door) frame as constructed, including a door, a side screen, a side light and mullions.

FIG. 3A is a plan view of a first example of a frame (in this instance, a doorframe) as assembled and FIG. 3B is a plan view of a second example of a frame (in this instance, a doorframe) as assembled. The example doorframe in FIG. 3A includes, two jambs (2), a lintel (6) and a sill (4), wherein the keys (14) attached to the upper end of each jamb (2) are retained in the keying channel (8) of the lintel (6) and the keys (14) attached to the lower end of each jamb (2) are retained in the keying channel (8) of the sill (4). The example doorframe in FIG. 3B further includes two mullions (3), each mullion (3) having a key (14) attached to each end. As with the keys (14) attached to the jambs (2), the key (14) attached to the upper end of each mullion (3) is retained in the keying channel (8) of the lintel (6) and the key (14) attached to the lower end of each mullion (3) is retained in the keying channel (8) of the sill (4). The use of mullions (3) allows additional spaces to be defined within the frame (in this instance, two additional spaces are defined by the frame, however one skilled in the art will appreciate that an arbitrary number of additional spaces may be chosen, depending on the frame design required). In this example, the additional spaces retain a sidelight (5) and a side screen (7), respectively.

Figure 4:
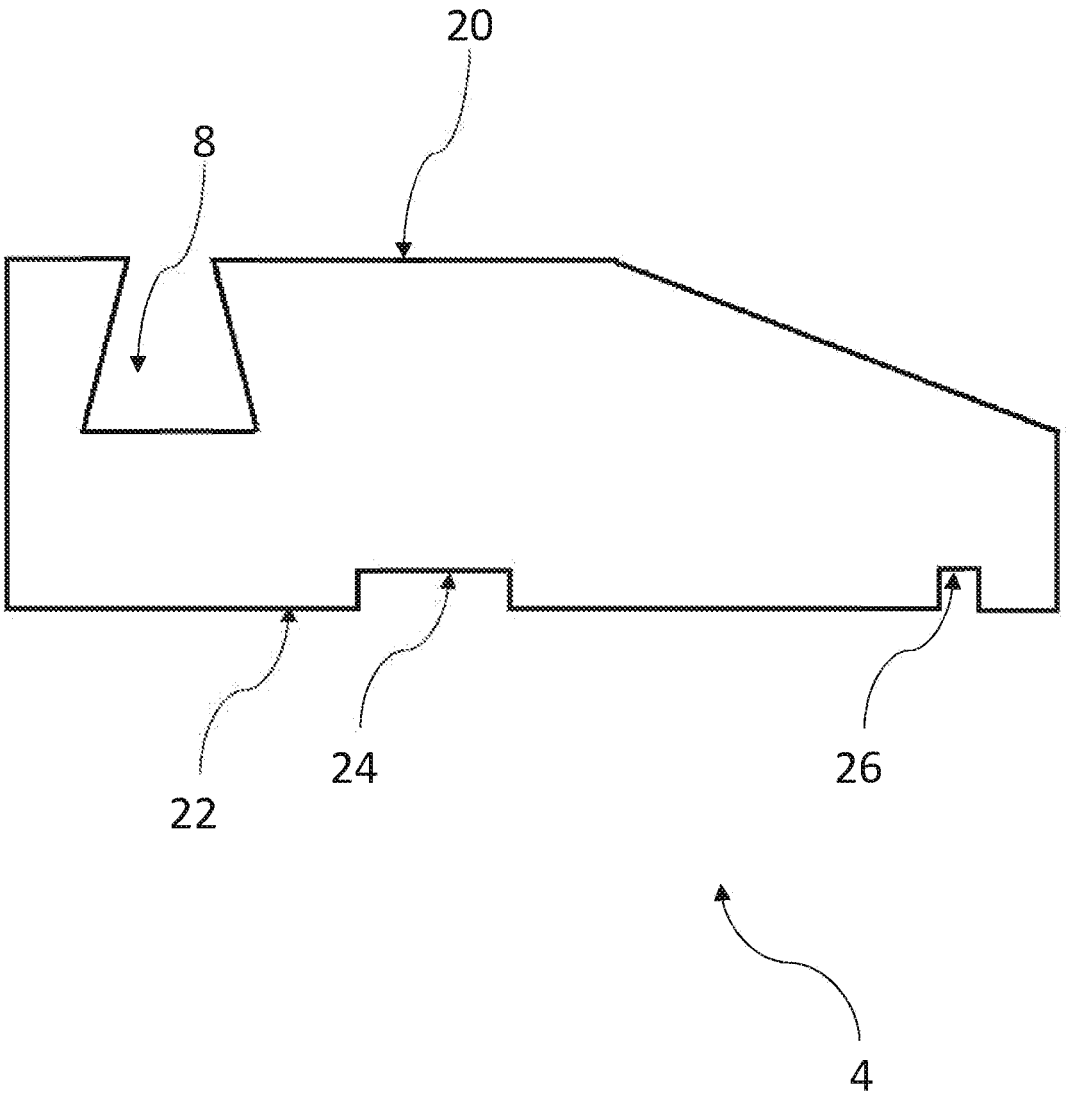
FIG. 4 is a cross-section of an example embodiment of a sill for a frame.

FIG. 4 is a diagram of an example cross-section of a sill (4) for a frame. The sill (4) has an upper surface (20), a lower surface (22) a dovetail slot (8), a sealant channel (24) and a drip channel (26). The dovetail slot (8) is configured to slidably receive a key (14) with the same cross-section (in this example, a dovetail); however, the dovetail slot is also configured to slidably receive a spacer (16) in the form of an elongate strut. During construction of a frame (1), a first key (14) that is connected to a first jamb (2) is inserted into the dovetail slot (8) of the sill (4) and is fixed in place. Then, a spacer (16) is inserted into the dovetail slot (8) of the sill (4), followed by a second key (14) that is connected to a second jamb (2) and this second key (14) is also fixed into place. However, it is also possible to insert the spacer (16) into the dovetail slot (8) of the sill (4) first and to subsequently insert the first and second keys (14) before fixing both keys into place. The spacer (16) is of sufficient length that it separates the first and second keys (14) such that the inner surfaces of the first and second jambs (2) define the leftmost and rightmost inner limits of the frame (1).

Figure 5:
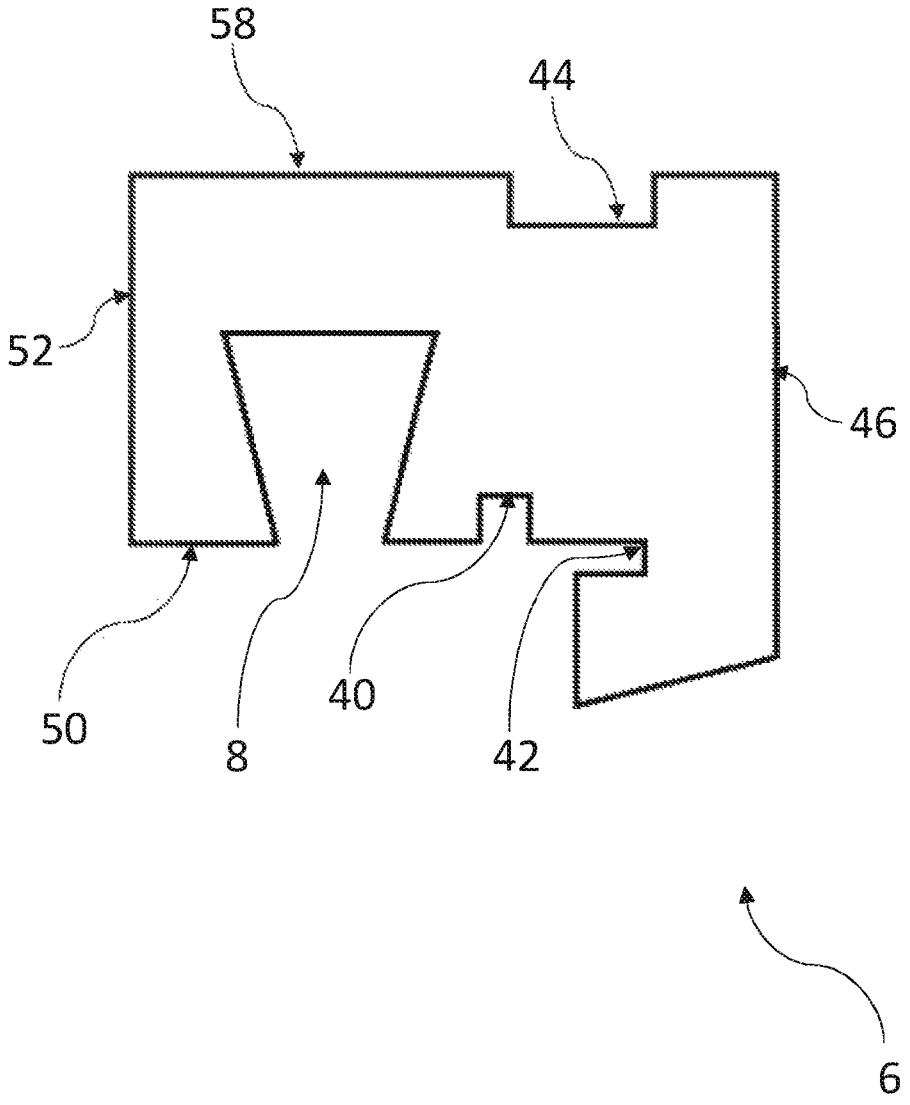
FIG. 5 is a cross-section of an example embodiment of a lintel for a frame.

FIG. 5 is a diagram of an example cross-section of a lintel (6) for a frame. The lintel (6) has an upper surface (58), a lower surface (50), a front surface (46), a back surface (52), a sealant channel (44) a dovetail slot (8), a gasket channel (42), and a drip channel (40). Each key (14) and each spacer (16) is configured to be slidably received by the dovetail slot (8). During construction of the frame, a first key (14) that is connected to a first jamb (2) is inserted into the dovetail slot (8) of the lintel (6) and is fixed in place. Then, a spacer (16) is inserted into the dovetail slot (8) of the lintel (6), followed by a second key (14) that is connected to a second jamb (2) and this second key (14) is also fixed into place. However, it is also possible to insert the spacer (16) into the dovetail slot (8) of the lintel (6) first and to subsequently insert the first and second keys (14) before fixing both keys (14) into place. The spacer (16) is of sufficient length that it separates the first and second keys (14) such that the in surfaces of the first and second jambs (2) define the leftmost and rightmost inner limits of the frame (1).

Figure 6:
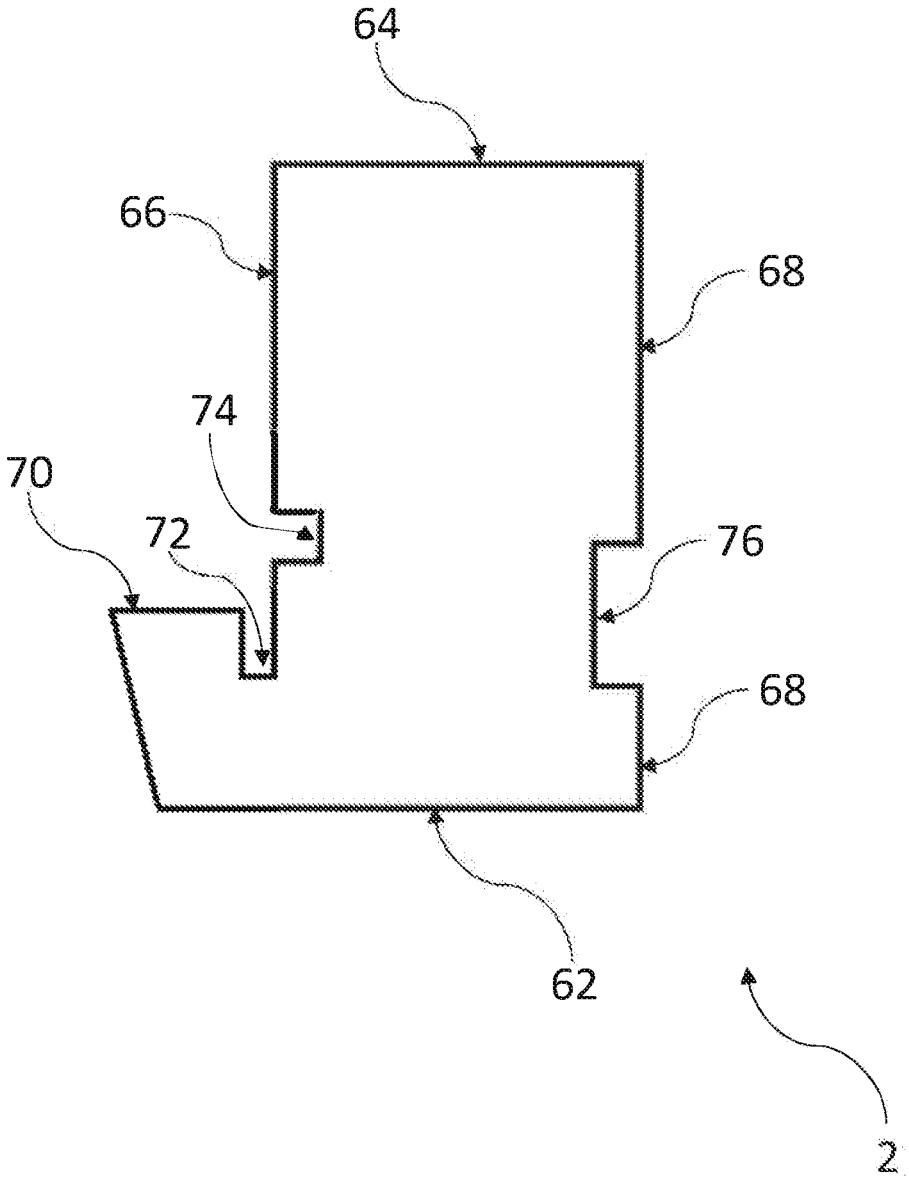
FIG. 6 is a cross-section of an example embodiment of a jamb for a frame.

FIG. 6 is a diagram of an example cross-section of a jamb (2) for a frame (2). The jamb (2) has an inner limit surface (66), an outer limit surface (68), an interior surface (64), an exterior surface (62), a sealant channel (76), a gasket channel (72) and a drip channel (74).

Figure 7:
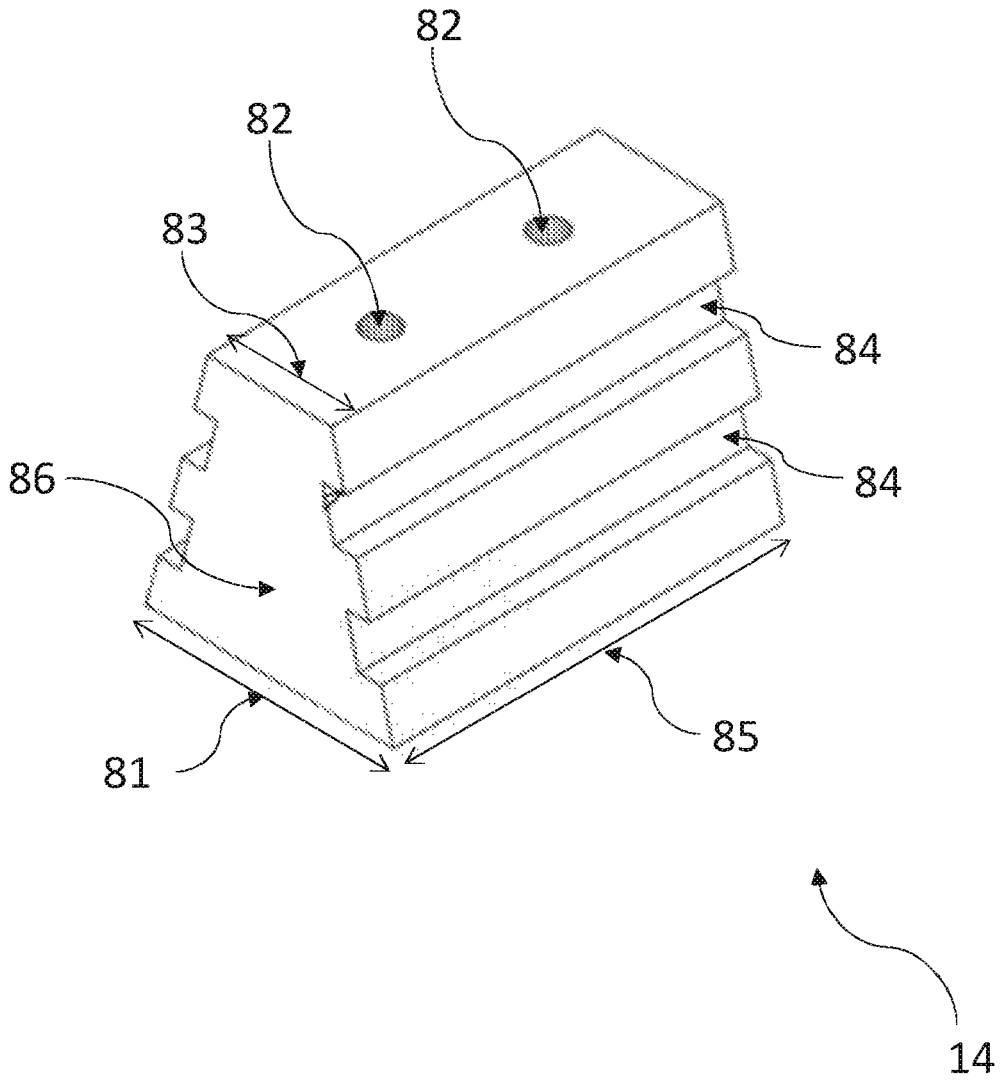
FIG. 7 is a perspective view of an example embodiment of a key in the form of a dovetail.

FIG. 7 is a diagram of one example of a key (14). The key (14) in this example has a dovetail cross-section (86) and as such is configured be slidably inserted into a (i.e. dovetail-shaped) key space (92) of a key jig (90), such as the key jig (90) shown in FIG. 8. However, one skilled in the art will appreciate that a range of shapes other than dovetails would also be effective, provided that the key (14) is configured to fit within the key space (92) of the key jig (90) and the keying channels (8). The key (14) also has adhesive channels (84) and through-bores (82) through which screws (or other fastening means) can be inserted in use to thereby fix the key to a jamb (2) or mullion (3). To ensure proper alignment, the dimensions of the key (14) must be known with some precision. In this example, the key has a length (85) of 35 mm, a lower width (81) of 22.2 mm, and an upper width (83) of 1 1.13 mm. One skilled in the art will appreciate that the choice of dimensions is may be decided according to the design requirements of the frame (1), provided that the dimensions of the key are consistent with those of the key jig (90).

The adhesive channels (84) reduce the frictional forces when the key (14) is inserted into the key space (92) of the key jig (90) and also can be filled with adhesive during construction of a frame (1), increasing the strength of any joint formed.

Figure 8:
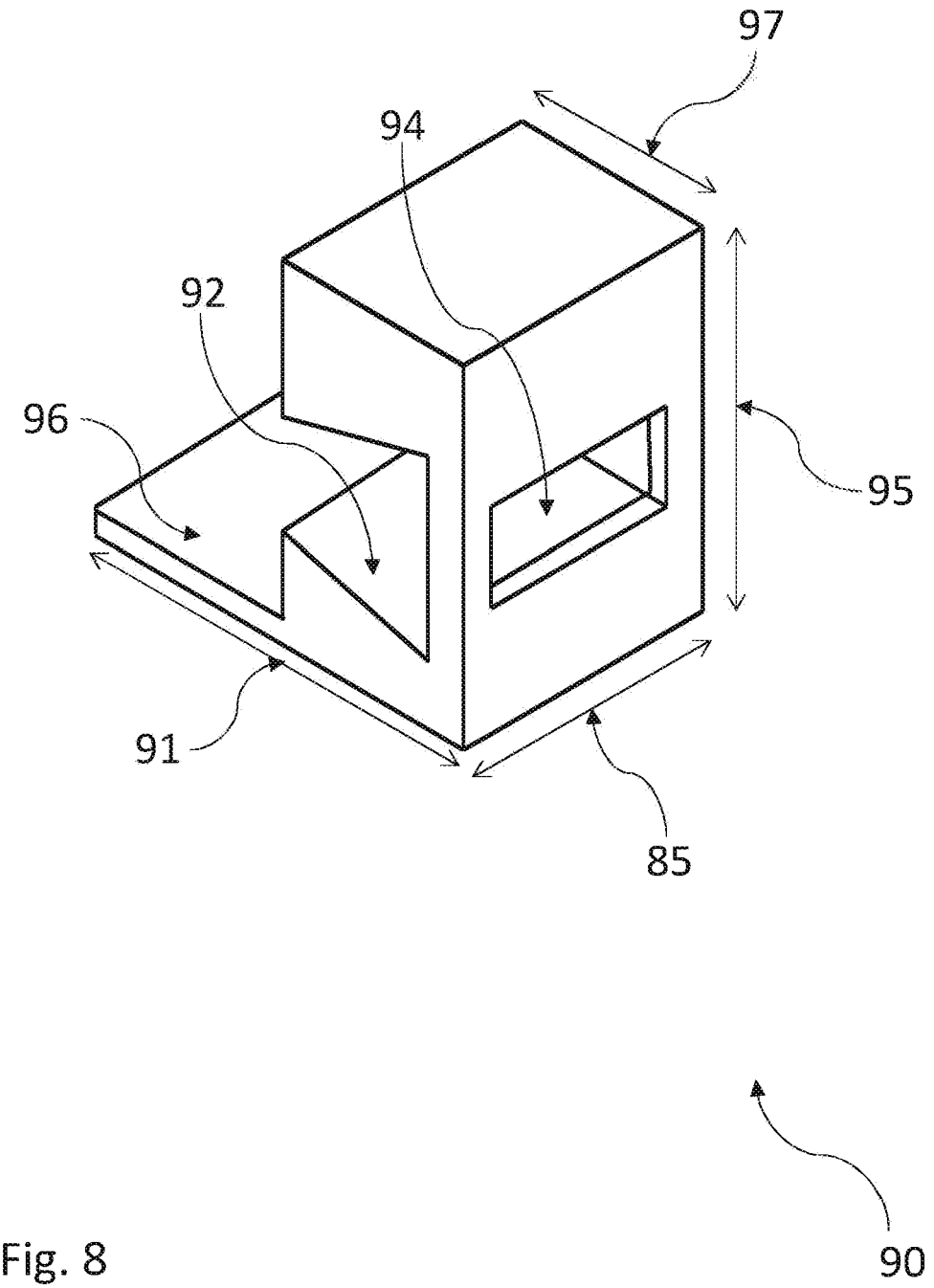
FIG. 8 is a perspective view of an example embodiment of a key jig.

FIG. 8 is a diagram of one example of a key jig (90). The key jig (90) has a key space (92) that, in this example, is configured to contain a key with a dovetail cross-section, however one skilled in the art will appreciate that a range of shapes would effective, provided that the key space (92) is configured to contain a key (14) with a matching cross-section. The key jig (90) also has a locating formation in the form of a backing section (96) configured to sit flush against the rear surface of a jamb (2) or mullion (3) and an access hole (94) through which screws (or other fastening means) can be inserted in use to thereby fix the key to the jamb. To ensure proper alignment, the dimensions of the key jig (90) must be known with some precision. In this example, the key jig (90) has a length (85) chosen to correspond with the length of the key (90) and as such is 35 mm. Including the height of the backing piece (96), the key jig (90) in this example has a total height (91) of 47 mm, and excluding the height of the backing piece a height (97) of 22 mm. The key jig (90) in this example has a depth (97) of 45 mm. One skilled in the art will appreciate that the choice of dimensions is may be decided according to the design requirements of the frame (1), provided that the dimensions of the key jig (90) and keying channels (8) are consistent with those of the key (14).

Accordingly, the dimensions of each key (14), spacer (16), key jig (90) and dovetail slot (8) can be selected such that the jamb (2) can be accurately laterally positioned in relation to the sill (4) and the lintel (6) according to the required dimensions of the frame (1).

Figure 9A:
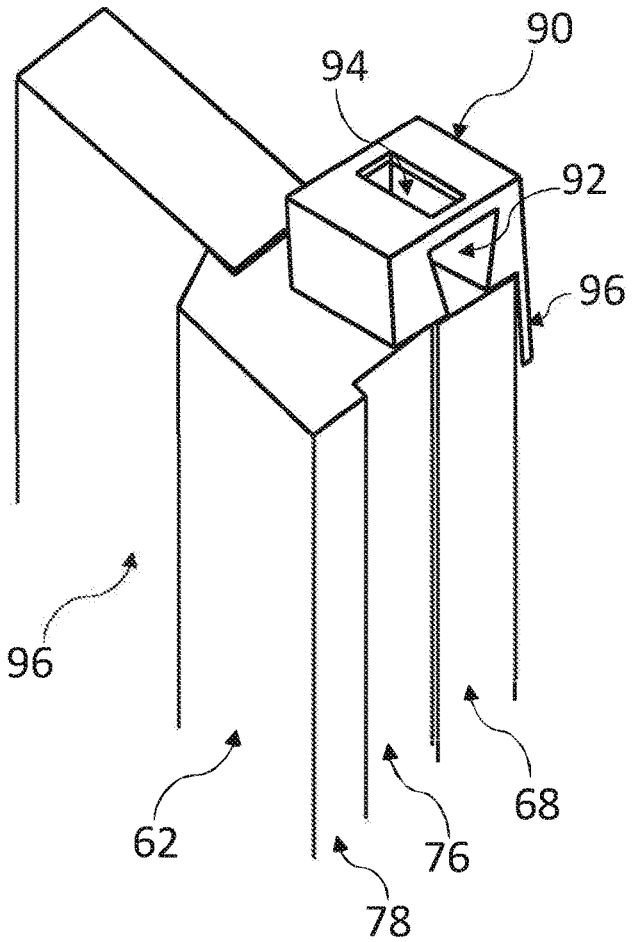
FIG. 9*a* is a diagram of the positioning of a key jig at the top of a jamb for a frame.
Figure 9B:
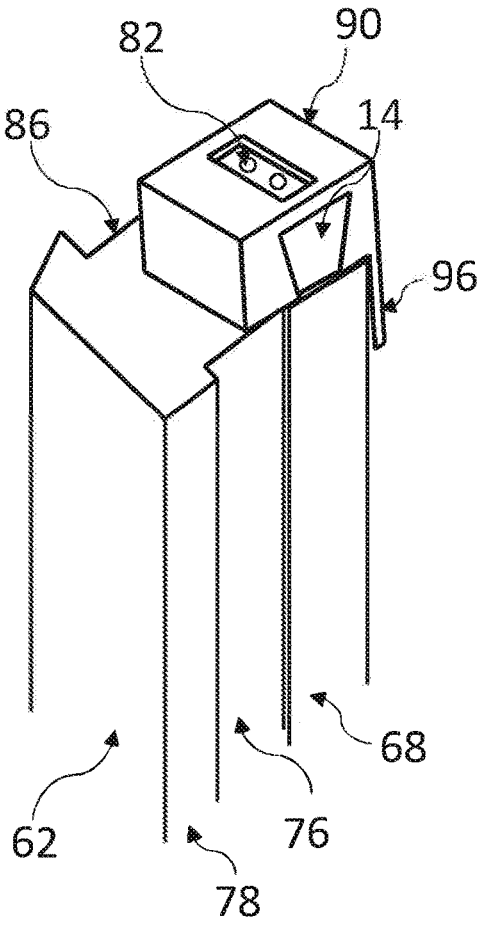
FIG. 9*b* is a diagram of the positioning of a key within a key jig at the top of a jamb for a frame.
Figure 9C:
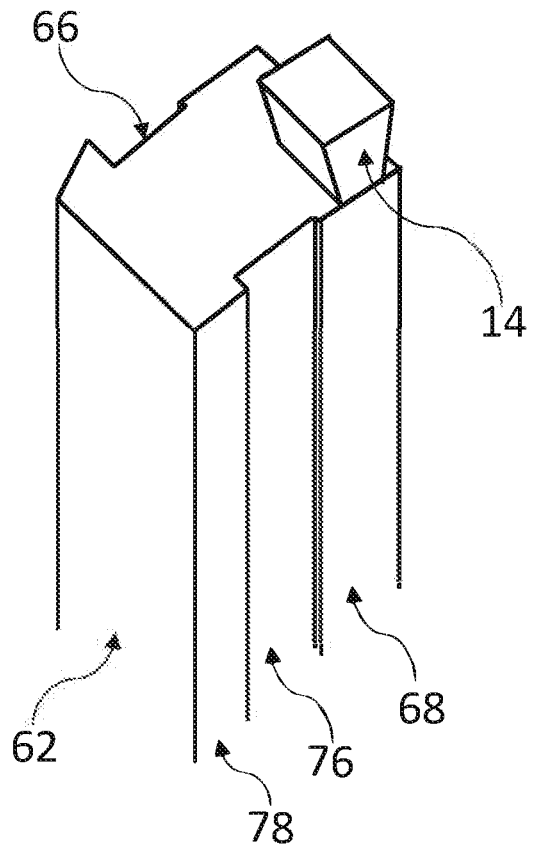
FIG. 9*c* is a diagram of the positioning of a key as attached at the top of a jamb for a frame.

FIG. 9*a* is a diagram of a key jig (90), positioned at the upper end of a jamb (2) (with a door (96) shown for illustrative purposes). In use, the key jig (90) is positioned such that the backing section (96) lies flush against the interior surface (64) of the jamb (2). FIG. 9*b* is a diagram of a key jig (90), positioned at the upper end of a jamb (2) (door omitted) with a key (14) inserted into the key space (92) of the key jig (90). In use, when the key (14) is correctly positioned it can then be connected to the jamb (2) by inserting screws via the access hole (94) of the key jig (90), into the through-bores (82) of the key (14) and into the jamb (2). The key jig (90) is then slidably removed from the key (14), leaving the key (14) attached to the jamb (2). This process is then repeated for the lower end of the jamb (2) to attach a second key (14), and is further repeated for as many jambs (2) (and/or mullions (3)) as are needed for the desired frame (1). FIG. 9*c* is a diagram of a key (14) fixed to the upper end of a jamb (2) (door omitted).

Figure 10:
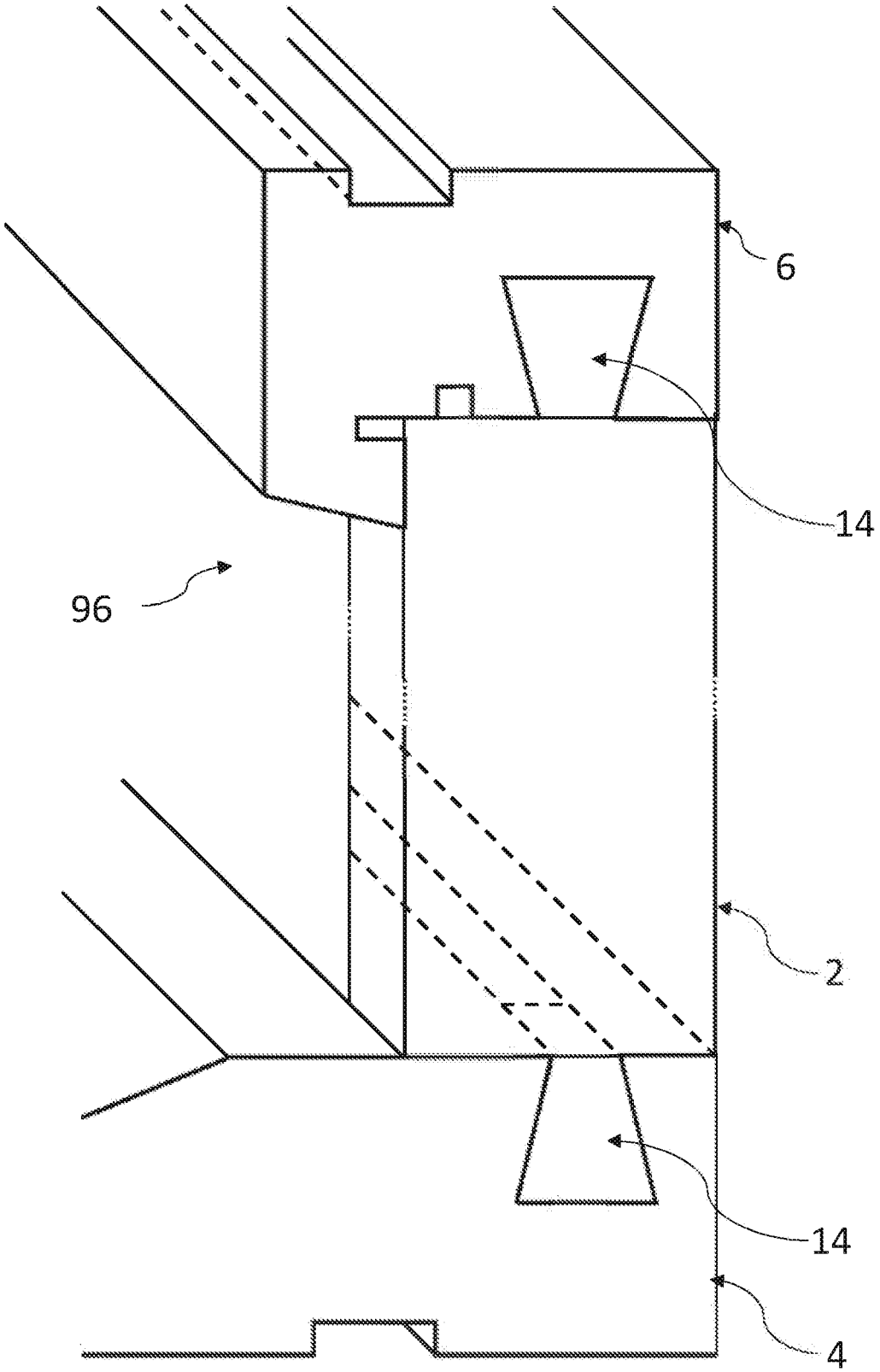
FIG. 10 is a diagram of a jamb with keys attached to each end, the keys being fitted into a sill and a lintel of a frame.

FIG. 10 is a diagram of part of a frame (1) indicating in more detail the positioning of the keys (14) attached to each end of a jamb (2) within the dovetail slot (8) of a sill (4) and a lintel (6) when a frame (1) is constructed.

It will be understood that in further embodiments of the invention additional jambs (2), mullions (3) (and keys (14) attached to the jambs (2) and/or mullions (3)) may be used to create frames with additional spaces to retain double doors and/or sidelights (5) and/or side screens (7). For example, by inserting an additional spacer into the keying channel of the sill (4) and a further additional spacer (16) into a keying channel of the lintel (6) and subsequently inserting a key (14) attached to the upper end of a mullion (3) into the keying channel of the lintel (6) and a key (14) attached to the lower end of a mullion (3) into the keying channel of the sill (4), an additional space is defined by the resulting frame (see FIG. 3). This additional space can then retain a sidelight (5) or a side screen (7). This process can optionally be repeated as many times as desired to create further additional spaces that can retain further sidelights (5) or side screens (7).

Figure 11:
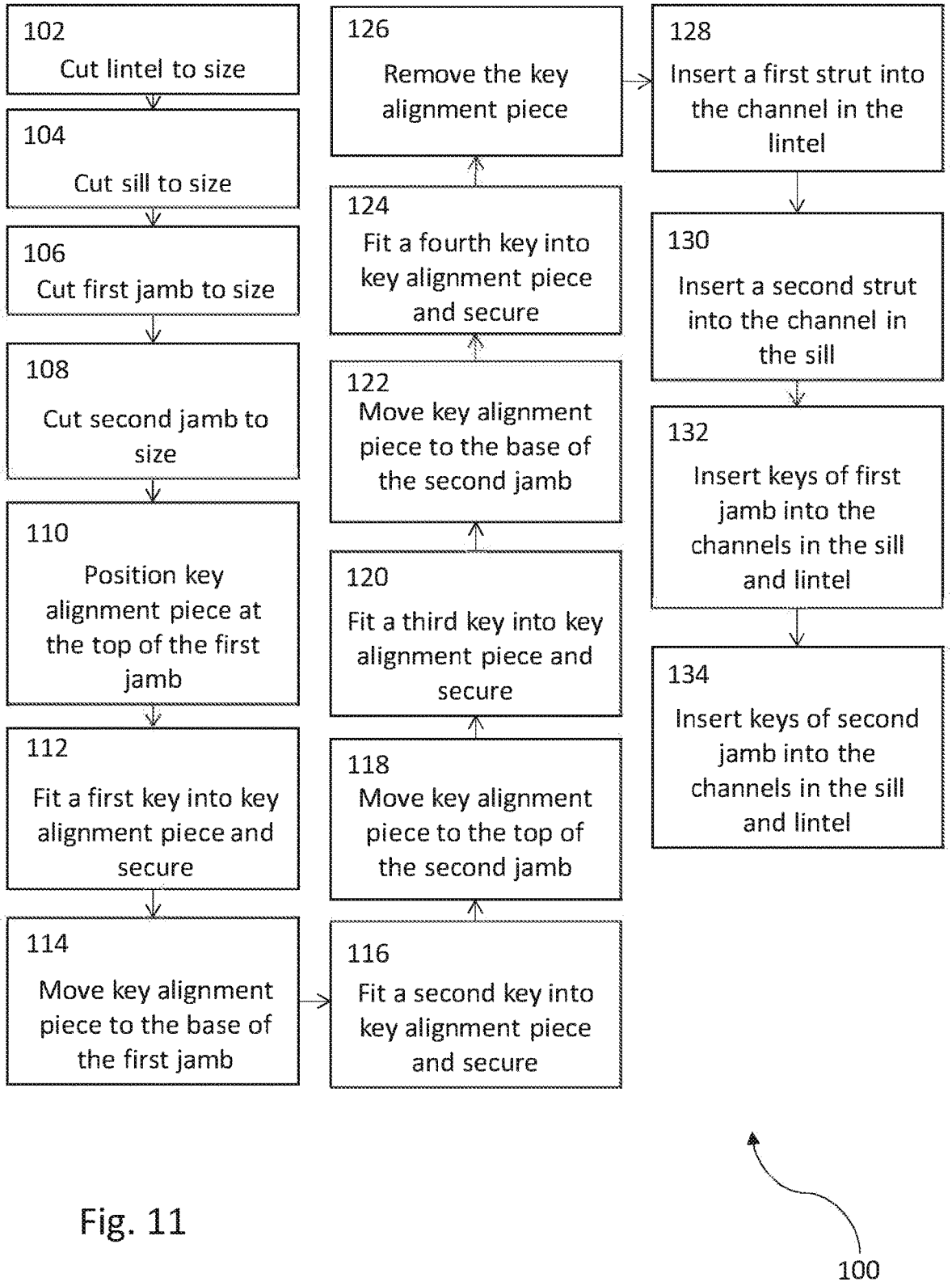
FIG. 11 is a flow chart of an example embodiment of the method as according to the invention.

A further embodiment of the invention provides a method as indicated in FIG. 11 which is a flow chart of the main steps of an example of the method (100) of constructing a frame (1) according to the invention. The method (100) begins with cutting the lintel to the required overall opening length (102) and then cutting the sill to the required overall opening length (104). Next, the first jamb (2) is cut to the required size for fitting between the sill and the lintel (106) and the second jamb (2) is cut to the required size for fitting between the sill and the lintel (108). One skilled in the art will appreciate that the dimensions chosen will depend on the space available. For example, where the frame is a doorframe the dimensions will depend on the space available for a door, the door itself, any excluder that is intended for use with the door and any required clearance space.

In this example, one key (14) is positioned at a time. When the sill (4), lintel (6) and first and second jambs (2) have been cut to size, the key jig (90) is positioned at the top of the first jamb (110) such that the backing section (96) of the key jig (90) is flush with the interior surface (64) of the first jamb (2). Then, a first key (14) is slidably inserted into the key space of the key jig and is secured (1 12) to the first jamb with screws inserted into the holes (82) of the first key (14) via the access hole (92) of the key jig (90). The next step is to remove the key jig (90) by sliding it off the first key (14) and to move it to the base of the first jamb (1 14). A second key is inserted into the key space of the key jig and is secured to the first jamb as before (1 16) and the key jig is then removed and moved to the top of the second jamb (1 18). Then, a third key is inserted into the key space and secured to the second jamb (120) and the key jig is moved to the base of the second jamb (122). A fourth key is inserted into the key space and secured to the second jamb (124) and the key jig is removed (126). At this point both jambs (2) have keys (14) attached to their upper and lower ends.

The next step in the method (100) is to insert a first spacer into the keying channel (in the above examples, a keying channel in the form of a dovetail slot) in the lintel (128) and then to insert a second spacer into the keying channel in the sill (in the above examples, a keying channel in the form of a dovetail slot) (130). Then, the keys of the first jamb are inserted into the channels in the lintel and the sill (132). Finally, the keys of the second jamb are inserted into the channels in the lintel and the sill (134) this completing the assembly of the frame. It will be appreciated that, in some examples of the invention, this method may comprise additional steps, and that some steps may be carried out in different orders or simultaneously.

What is claimed is:

1. A method of assembling a frame, the method comprising, providing or forming a sill of a selected length, the sill having at least one keying channel running along at least part of a longitudinal surface of the sill;

providing or forming a lintel of a selected length, the lintel having at least one keying channel running along at least part of a longitudinal surface of the lintel;

providing or forming at least two jambs of a selected length, each jamb having keys extending longitudinally out from a top end and a base end of the said jamb, said keys shaped to cooperate with and be retained by said keying channels;

inserting the keys at one end of each jamb into the at least one keying channel of the lintel; and inserting the keys at the other end of each jamb into the at least one keying channel of the sill, to thereby form the frame, such that each keying channel faces an aperture of the frame.

2. The method according to claim 1 wherein the method comprises cutting one or more jambs to a selected length and subsequently forming a key at least one end of the or each jamb.

3. The method according to claim 1 wherein the forming of at least two jambs of a selected length further comprises the step of attaching a key to each end of each jamb, optionally using a key jig to align the key.

4. The method according to claim 1 wherein the forming of at least two jambs of a selected length comprises cutting one or more of the jambs to the selected length and the method further comprises attaching a key to each end of each jamb, optionally using a key jig to align the key.

5. The method according to claim 1 further comprising the step of attaching of a key to each end of each jamb comprising, placing at least one key jig against and aligning the at least one key jig with an end of the jamb;

aligning a key with the or each key jig;

attaching the or each key to the end of the jamb; and removing the or each key jig from the end of the jamb.

6. The method according to claim 1 wherein the forming of the sill of a selected length and/or the lintel of a selected length and/or the at least two jambs of a selected length comprises cutting one or more lengths of material to a selected length.

7. The method according to claim 1 wherein the forming of a sill of a selected length and/or the lintel of a selected length and/or the at least two jambs of a selected length comprises forming the jambs and/or lintels and/or sills to a selected length by cutting through a longer piece of material at a site of use.

8. The method according to claim 1 further comprising the step of separating the at least two jambs by a selected distance to thereby define a width of the frame.

9. The method according to claim 8 wherein the step of separating the at least two jambs comprises the steps of, inserting a first locator into at least one keying channel of the lintel;

inserting a second locator into at least one keying channel of the sill;

inserting the keys attached to the top of each jamb into the keying channel of the lintel; and inserting the keys attached to the base of each jamb into the keying channel of the sill.

10. The method according to claim 1 further comprising, forming one or more additional jambs and/or one or more mullions each of a selected length, the or each additional jamb and/or the or each mullion having longitudinally extending keys at either end;

inserting the keys attached to the top of the or each additional jamb and/or the or each mullion into the at least one keying channel of the lintel; and inserting the keys attached to the base of the or each additional jamb and/or the or each mullion into the at least one keying channel of the sill.

11. The method according to claim 10 wherein the forming of one or more additional jambs and/or one or more mullions each of a selected length, each jamb having longitudinally extending keys at either end comprises attaching a key to each end of each additional jamb and/or each mullion, optionally through using a key jig to align the key.

12. The method according to claim 10 wherein the attaching of a key to each end of each additional jamb and/or each mullion comprises the steps of, placing at least one key jig against and aligning the at least one key jig with an end of one or more additional jambs and/or one or more mullions;

aligning a key with the or each key jig;

attaching the or each key to the end of the or each additional jamb and/or the or each mullion; and removing the or each key jig from the end of each additional jamb and/or the or each mullion.

13. The method according to claim 10 comprising separating the or each additional jamb from the first and second jambs by a selected distance.

14. The method according to claim 10 comprising separating the or each mullion from the at least two jambs or at least two jambs of the one or more additional jambs.

15. The method according to claim 10 wherein the separating the additional jambs and/or mullions comprises the steps of, inserting an additional locator into at least one keying channel of the lintel;

inserting an additional locator into at least one keying channel of the sill;

inserting the keys attached to the top of the or each additional jamb and/or the or each mullion into the keying channel of the lintel; and inserting the keys attached to the base of the or each additional jamb and/or the or each mullion into the keying channel of the sill.

* * * * *